US007032848B2

(12) United States Patent
Colson

(10) Patent No.: US 7,032,848 B2
(45) Date of Patent: Apr. 25, 2006

(54) METHOD AND APPARATUS FOR HYDROMECHANICALLY DISINTEGRATING ORGANIC MATTER

(76) Inventor: Cameron M. Colson, 656 E. Taylor Ave., #2, Sunnyvale, CA (US) 94086

( * ) Notice: Subject to any disclaimer, the term of this patent is extended or adjusted under 35 U.S.C. 154(b) by 166 days.

(21) Appl. No.: 10/460,989

(22) Filed: Jun. 13, 2003

(65) Prior Publication Data

US 2003/0230651 A1 Dec. 18, 2003

Related U.S. Application Data

(60) Provisional application No. 60/389,112, filed on Jun. 13, 2002.

(51) Int. Cl.
*B02C 19/18* (2006.01)

(52) U.S. Cl. ..... 241/1; 241/95; 241/168; 241/74; 241/301

(58) Field of Classification Search ..... 83/53, 83/177; 241/1, 301, 36, 74, 95, 68, 168; 239/447, 381
See application file for complete search history.

(56) References Cited

U.S. PATENT DOCUMENTS 4,204,646 A * 5/1980 Shames et al. ..... 239/381
4,986,479 A * 1/1991 Swarden et al. ..... 241/15
5,035,362 A * 7/1991 Mazurkiewicz ..... 241/1
5,090,624 A * 2/1992 Rogers ..... 239/381
5,323,969 A 6/1994 Mendenhall et al. ..... 241/1
5,356,081 A 10/1994 Sellar ..... 241/1
5,582,686 A * 12/1996 Chupka et al. ..... 162/194
5,794,861 A 8/1998 Rutherford, Sr. ..... 241/1

OTHER PUBLICATIONS

"A Collaborative Approach for Reducing Wildland Fire Risk to Communities and the Environment," 10-Year Comprehensive Strategy, Aug. 2001.
California Water Code Section §§520-523, 2003.
Campbell City Code Section §6.10.020, 2003.

* cited by examiner

*Primary Examiner*—Mark Rosenbaum
(74) *Attorney, Agent, or Firm*—Haverstock & Owens LLP

(57) ABSTRACT

An apparatus for disintegrating waste matter preferably comprising a holding area for holding waste matter; and a fluid delivery mechanism for applying high pressure fluid to the holding area, wherein the high pressure fluid disintegrates the waste matter and applies a force sufficient to hydromechanically sever the waste matter. The holding area preferably includes a container bin having a bottom surface and an outer wall. Alternatively, the apparatus is a hand held device. An outlet port coupled to the bottom surface, wherein the disintegrated waste material exits the container bin via the outlet port. A fluid source coupled to the fluid delivery mechanism. The fluid delivery mechanism comprises at least one nozzle for applying a stream of highly pressurized fluid to the waste. The nozzle preferably includes a zero degree nozzle tip The fluid delivery mechanism comprises a column or a disk manifold, wherein the nozzle extends therefrom.

42 Claims, 8 Drawing Sheets

METHOD AND APPARATUS FOR HYDROMECHANICALLY DISINTEGRATING ORGANIC MATTER

RELATED APPLICATION

This Patent Application claims priority under 35 U.S.C. 119 (e) of the U.S. Provisional Patent Application, Ser. No. 60/389,112 filed Jun. 13, 2002, and entitled "APPARATUS AND METHOD OF HYDROMECHANICALLY SEVERING FOLIAGE". The Provisional Patent Application, Ser. No. 60/389,112 filed Jun. 13, 2002, and entitled "APPARATUS AND METHOD OF HYDROMECHANICALLY SEVERING FOLIAGE" is also hereby incorporated by reference.

FIELD OF THE INVENTION

The invention relates to a method and apparatus for disposing waste in general, and specifically, to a method and apparatus for hydromechanically disintegrating waste.

BACKGROUND OF THE INVENTION

Solid waste is generated in mass quantities everyday and many methods of disposing the solid waste exist. In particular to lawn and garden care, organic solid waste such as weeds, shrubbery, leaves, grass, food, foliage, blight and other organic matter is currently disposed of using conventional cutting technologies, chemicals, incineration and other methods. Conventional cutting technologies include, but are not limited to, rotary or sickle mowers, leaf blowers, rakes, hedge trimmers, saws or chipper shredders and machetes. Although the methods of controlling lawn and garden waste using chemicals are effective, they can be expensive, non-reusable and potentially harmful to the environment such as soil, water or air contamination. The use of chemical growth management also creates erosion which can in effect cause persistent toxins to be distributed in the environment through the chemical mixture within the areas that the chemical is applied.

Conventional cutting tools which are widely used to control vegetation, however take a substantial amount of time, resources, steps and labor to perform the controlling process. In addition, conventional cutting tools require the use of fuel to operate, which impact society's dependence on fossil fuels. In the home, food stuffs are often disposed of by using conventional garbage disposals or trash compactors which can be quite dangerous to the user due the presence of moving blades. Burning and incineration of organic matter, as is done by fire departments and governmental agencies, causes air pollution which can be harmful to humans and animals inhaling the smoke. Nonetheless, incineration also produces ash and can spread uncontrollably if not properly contained.

What is needed is a method and apparatus for controlling and disposing of waste material using a non-toxic reusable source, such as water. What is also needed is a method and apparatus for disposing waste material which eliminates the dependence on chemicals. What is further needed is a method and apparatus for disposing waste material which is non-expensive and safe and is beneficial to the reuse of water.

SUMMARY OF THE INVENTION

In one aspect of the invention, an apparatus which disintegrates waste matter preferably comprises a holding area which holds waste matter and a fluid delivery mechanism which applies high pressure fluid to the holding area. The high pressure fluid disintegrates the waste matter and applies a force sufficient to hydromechanically sever the waste matter. In one embodiment, the apparatus is a hand held device used to sever waste. In another embodiment, the apparatus includes a holding area which includes a container bin which has a bottom surface and an outer wall which extends perpendicularly to the bottom surface. The apparatus further comprises an outlet port that is coupled to the bottom surface, wherein the disintegrated waste material exits the container bin via the outlet port. The apparatus further comprises a fluid source that is coupled to the fluid delivery mechanism and provides highly pressurized fluid thereto. The fluid delivery mechanism is preferably disposed within the container bin. The fluid delivery mechanism further comprises at least one nozzle which applies a stream of highly pressurized fluid to the waste matter and preferably includes a zero degree nozzle tip which concentrates the highly pressurized fluid exiting the nozzle into a manageable stream. The fluid delivery mechanism preferably includes a column that is configured along a longitudinal axis. The nozzle preferably extends out from the column substantially towards the outer wall. The fluid delivery mechanism alternatively comprises a disk manifold that is configured to be substantially parallel to the bottom surface, wherein the at least one nozzle extends from the disk manifold substantially towards the bottom surface. The fluid delivery mechanism rotates about a longitudinal axis to rotatably disintegrate the waste material within the container bin. By forcing the waste through the mesh exterior perimeter, the mesh surface is utilized as a cutting surface.

In another aspect of the invention, an apparatus which hydromechanically severs waste material preferably comprises a receptacle that contains the waste material. In another embodiment, the apparatus is a hand held device. In the preferred embodiment, at least one nozzle is coupled to the receptacle and is configured to apply a stream of highly pressurized fluid to the waste material, wherein the stream of highly pressurized fluid severs the waste material by force. The receptacle further comprises a bottom surface and an outer wall that extends perpendicularly to the bottom surface. The apparatus preferably includes an outlet port that is coupled to the bottom surface. The disintegrated waste material exits the receptacle via the outlet port. The apparatus further comprises a fluid source that is coupled to the at least one nozzle, wherein the fluid source provides the highly pressurized fluid to the at least one nozzle. The at least one nozzle further comprises a zero degree nozzle tip which compresses fluid entering the at least one nozzle. The apparatus further comprises a column that is configured along a longitudinal axis, wherein the at least one nozzle extends outward from the column and substantially towards the outer wall. The fluid delivery mechanism further comprises a disk manifold that is configured to be substantially parallel to the bottom surface. At least one nozzle extends from the disk manifold and is substantially towards the bottom surface. The column rotates about a longitudinal axis to rotatably sever the waste material within the receptacle.

In yet another aspect of the invention, a method of decomposing waste matter comprises the steps of providing a waste matter. The method comprises configuring a fluid delivery mechanism to direct a highly pressurized fluid toward the waste matter. The method also comprises applying the highly pressurized fluid through the fluid delivery mechanism, wherein the fluid delivery mechanism applies the highly pressurized fluid to disintegrate the waste matter. The high pressure fluid applies a force sufficient to hydromechanically sever the waste matter. The holding area further comprises a container bin which has a bottom surface and an outer wall that extends perpendicularly to the bottom surface. The method further comprises coupling an outlet port to the bottom surface, wherein the disintegrated waste material exits the container bin via the outlet port. The method further comprises coupling a fluid source to the fluid delivery mechanism, wherein the fluid source provides the highly pressurized fluid to the fluid delivery mechanism. The fluid delivery mechanism is preferably disposed within the container bin. The fluid delivery mechanism further comprises at least one nozzle, whereby the at least one nozzle compresses fluid that enters the at least one nozzle into the high pressure fluid by utilizing a zero degree nozzle tip. The method further comprises configuring the fluid delivery mechanism to preferably include a column that is positioned along a longitudinal axis, wherein the at least one nozzle extends outward from the column and is directed substantially toward the outer wall. The method alternatively comprises configuring the fluid delivery mechanism include a disk manifold that is positioned to extend toward the bottom surface. The method further comprises configuring the fluid delivery mechanism to rotate about an axis to rotatably disintegrate the waste material within the container bin.

In yet another aspect of the invention, an apparatus which decomposes waste matter comprises means for holding waste matter and means for applying high pressure fluid to the holding area, wherein the high pressure fluid disintegrates the waste matter into effluent matter.

DETAILED DESCRIPTION OF THE PRESENT INVENTION

The present invention is directed to a method and apparatus for disintegrating waste material with the beneficial reuse of water in general. Specifically, the present invention is directed toward assisting governmental operations, such as Caltrans operations, as well as fire services, horticultural control, and seasonal foliage control that is subject to being classified as having fire hazard potential. It is apparent that the present invention is not limited to these specific applications and is alternatively used for other applications. For instance, the present invention can be used for mine detection and pest reduction.

Disintegration of the waste matter occurs by the high pressure fluid being directed toward the waste in a controlled manner, whereby the fluid erodes, implodes, explodes, crushes, minces or otherwise liquefies the waste upon contact. The present invention thereby eliminates the dependence on chemicals for vegetation and weed control under Environmental Preferable Products under EPA guidelines and can utilize reclaimed water which is generated from the sanitary system (purple water) in accordance with local, state and federal government environmental guidelines. The present invention preferably operates under the standard operating procedure granted by federal, state and local governmental entities. In addition, the present invention performs the same functions as conventional vegetation cutting tools and mechanisms with superior results and effectiveness with less amount of time, labor and performing steps. It should be emphasized that conventional cutting tools include all devices and machines currently used to control organic matter and perform organic control management. Some examples of organic control management tools include, not are not limited to, rotary or sickle mowers, leaf blowers, rakes, hedge trimmers, saws or chipper shredders and machetes, incinerators, chemicals, garbage disposals, weed-whackers, plows, ground tillers and lawn mowers.

Figure 1:
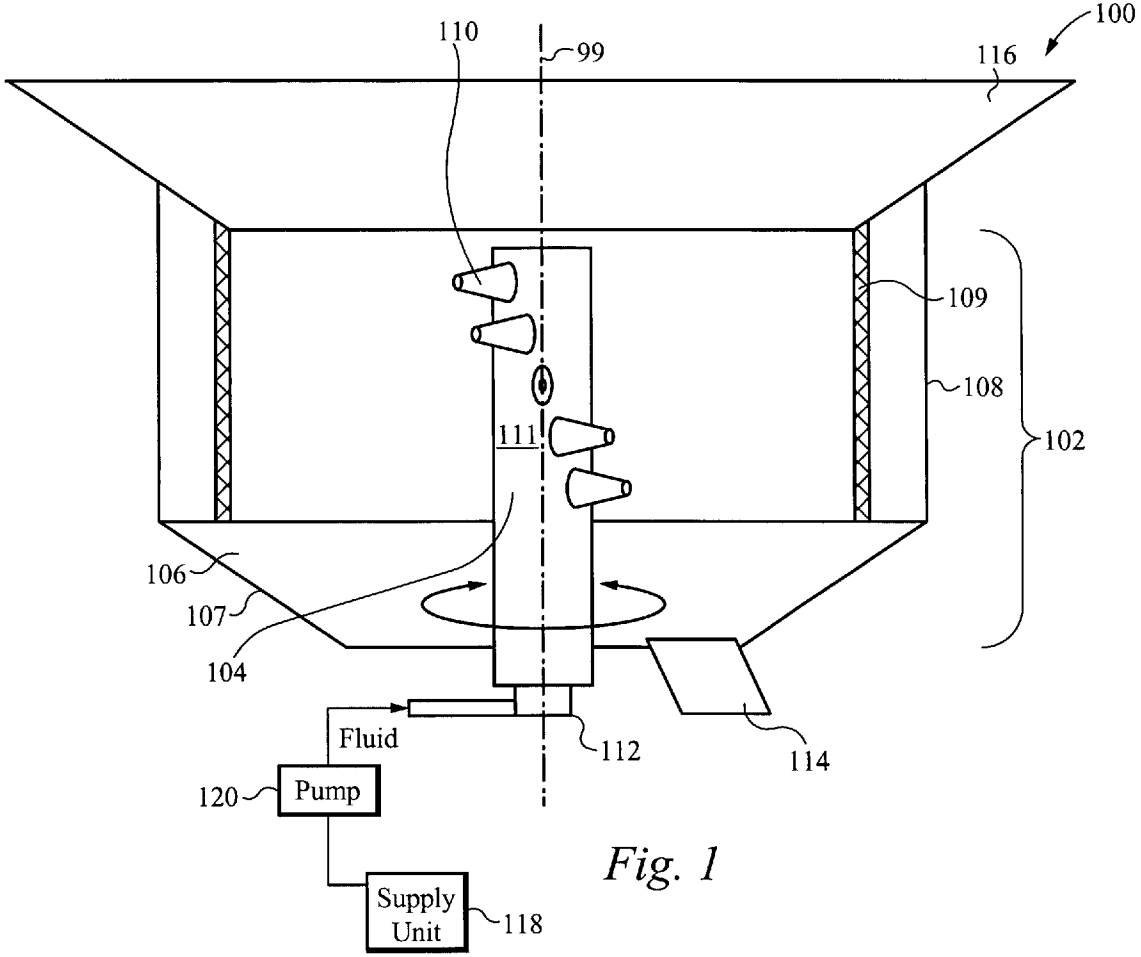
FIG. 1 illustrates a side view schematic of a preferred waste disintegrating apparatus in accordance with the present invention.

FIG. 1 illustrates a side view schematic of a preferred waste disintegrating apparatus in accordance with the present invention. Generally, as shown in FIG. 1, the apparatus 100 preferably includes a container 102, a feeder component 116, a fluid delivery system 104, a pump 120, a fluid input port 112 and an output port 114. In particular, as shown in FIG. 1, the container 102 holds waste material during the liquefying or disintegrating process and includes a bottom component 106 having a bottom surface 107 as well as an outer wall 108 which is coupled to the bottom component 106. Preferably the outer wall 108 contains the waste matter and fluid from the fluid delivery mechanism 104 within the container 100. A grating surface 109 is positioned parallel to the outer wall 108, whereby the grating surface 108 assists in disintegrating the waste. Preferably the outer wall 108 has a circular, cylindrical shape and the grating surface 108 is preferably made of a wired mesh material. Alternatively, the outer wall 108 has any other appropriate shape and the grating surface 109 is made of any other appropriate material.

The feeder component 116 is coupled to the container 102 and allows trash and other waste to be placed within the container 102. Alternatively, the trash and waste is inserted into the container 102 through a side door (not shown) of the container 102. The output port 114 is coupled to the bottom component 106 and allows effluent or disintegrated waste to flow out of the apparatus 100. The effluent matter is thereby reusable as compost or mulch and has substantial advantages over conventional controlling methods. Preferably, the waste matter includes, but is not limited to, blight, such as, foliage, leaves, weeds, shrubbery, roots, or any other organic or inorganic matter. In addition, the waste preferably has solid properties, although waste having a mixture of liquid and solid properties is alternatively contemplated.

Figure 2:
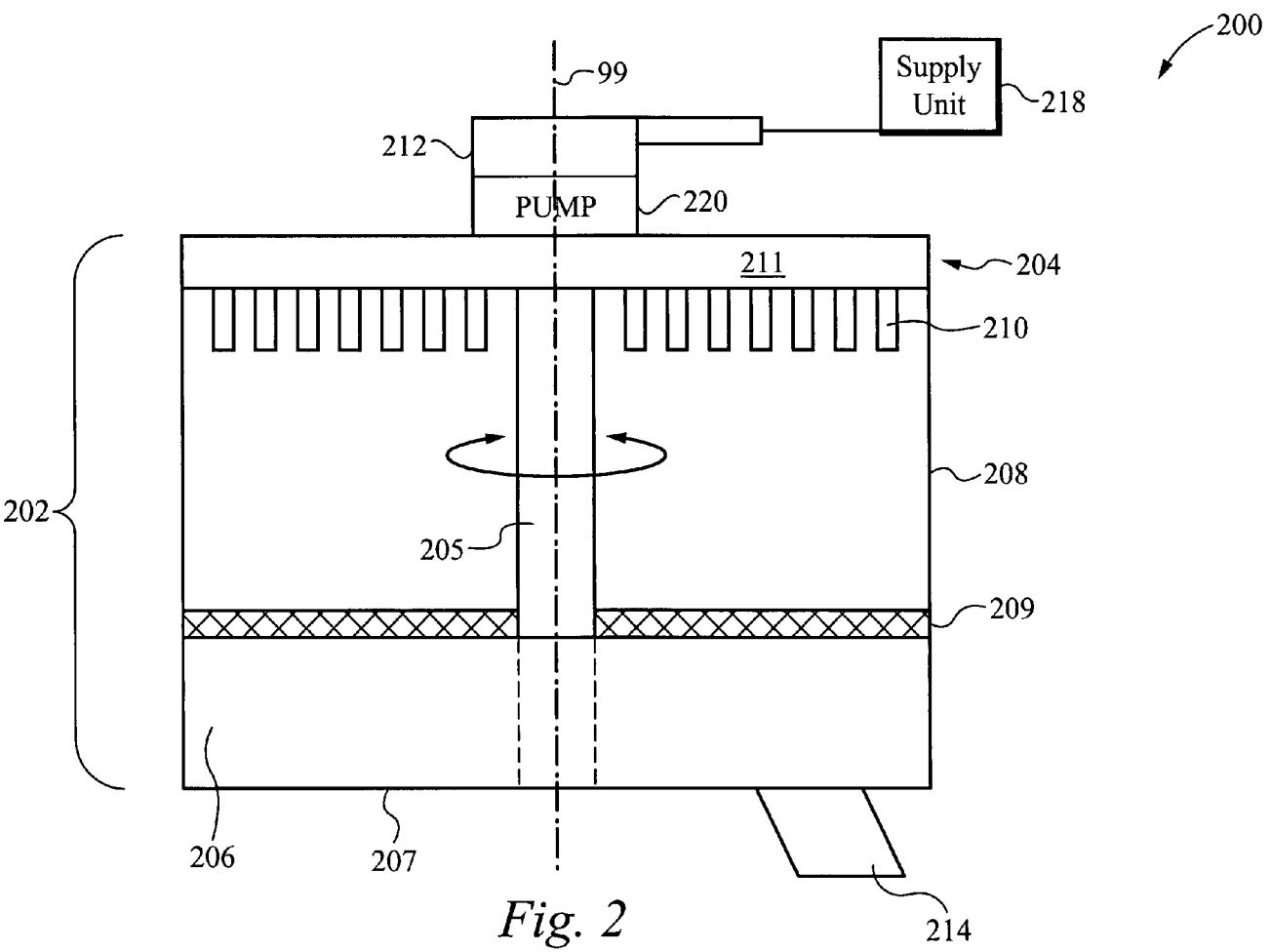
FIG. 2 illustrates a side view schematic of an alternative waste disintegrating apparatus in accordance with the present invention.

The input port 112 is preferably coupled to the bottom component 106 and is coupled to the fluid supply unit 118. Alternatively, the fluid input port 112 is configured on top of the apparatus 100, as shown in FIG. 2. As shown in FIG. 1, the fluid delivery mechanism 104 is coupled to the fluid input port 112, whereby fluid from the fluid supply unit 118 flows directly to the fluid delivery mechanism 104 via the fluid input port 112. The fluid supply unit 118 is preferably a municipal water source, although the fluid supply unit 118 is alternatively any other water source including, but not limited to a well and water tank. It is preferred that the fluid is water, although any other appropriate liquid is alternatively contemplated. The fluid entering the fluid input port 112 preferably flows through the pump 120, whereby the pump 120 compresses the fluid to be under a high pressure. In addition, it is apparent to one skilled in the art that the fluid supplied by the fluid supply unit 118 is already at high pressure, whereby the fluid is preferably further compressed at the nozzles 110.

The fluid delivery mechanism 104 delivers one or more streams of highly pressurized fluid, whereby the highly pressurized fluid disintegrates or hydromechanically severs the waste matter upon contact in the container 102. The fluid delivery mechanism 104 is preferably configured within the container 102 and includes a cylindrical manifold or column 111 which protrudes vertically from the bottom surface 107 of the bottom component 106. Alternatively, the fluid delivery mechanism 104 is also disposed along the outer surface or outside the container, whereby the nozzles 110 point toward the center of the container 102. Preferably the nozzles 110 are recessed within the manifold 111, whereby the nozzles 110 are not exposed to breakage. Alternatively, the nozzles 110 extend out from the manifold, as shown in FIG. 1. Preferably, the manifold 111 has a circular cylindrical configuration. Alternatively, the manifold 111 has any other shaped configuration. In the preferred embodiment, the manifold 111 is positioned perpendicular to the bottom surface 107 and extends along the axis 99. The outer surface of the manifold 111 is parallel to the outer wall 108, as shown in FIG. 1.

The fluid delivery mechanism 104 preferably includes only one nozzle 110 which extends out, preferably substantially perpendicular, from the manifold 111 and is pointed toward the outer wall 108 as well as the bottom component 106. It is preferred that the nozzle 110 is capable of moving vertically or horizontally along the axis 99 while the fluid delivery mechanism 104 operates. Alternatively, the fluid delivery mechanism 104 includes more than one nozzle 110. For discussion purposes, the present description refers to the fluid delivery mechanism having more than one nozzle 110. As shown in FIG. 1, the ports leading to the nozzles 110 are disposed in a spiral arrangement around the manifold 111. As discussed below, the nozzles 110 are configured to apply a high pressure fluid to the waste matter within the container 102 thereby hydromechanically severing or disintegrating the waste matter into effluent matter. The effluent matter is thereby reusable as compost or mulch and has substantial advantages over by-products generated by conventional controlling methods.

The high pressure fluid preferably flows upwards through the manifold 111 and is forced out through the nozzle 110 as a stream of highly pressurized fluid. The manifold 111 includes one or more fluid lines within which appropriately channel the high pressure fluid from the fluid input port 112 to the one or more nozzles 110. The nozzle 110 preferably includes a zero degree nozzle tip which concentrates the fluid into a manageable stream as it exits the nozzle 110. The nozzle 110 also preferably rotates about the nozzle outlet, whereby the nozzle 110 forces fluid in a pulsating, oscillating manner. The pulsating manner in which the fluid exits the nozzle aids in severing and disintegrating waste matter with the least amount of fluid expenditure. Alternatively, a nozzle having the ability to further compress the highly pressurized fluid is contemplated. It is contemplated by one skilled in the art that other appropriate nozzles are useable in conjunction with the fluid delivery system of the present invention. The pressure of the fluid is preferably within the range of, and including, 3000 psi and 10,000 psi and is within the industry standard of maximum pressure allowed. Preferably, the pressure of the fluid exiting the nozzle 110 is at 5000 psi. Alternatively, other pressures are contemplated.

The stream of highly pressurized fluid is directed at the waste matter within the container 102, whereby the fluid strikes the waste at such a high force that the fluid effectively disintegrates or liquefies the waste into effluent matter. In other words, the force of the fluid stream strikes the waste and effectively severs or slices the waste at the point of contact. Therefore, in the apparatus shown in FIG. 1, a stream of highly pressurized fluid is delivered through each of the nozzles 110 in the manifold 111 toward the waste which is located in between the manifold 111 and the outer wall 108. Preferably, only one stream of fluid severs and disintegrates the waste as well as pushes the waste toward the outer wall 108 of the container 102. The outer wall 108 preferably confines the fluid within the container 102 so that fluid does not stray outside of the container 102. As shown in FIG. 1, the apparatus 100 preferably includes a screen or wire mesh grating surface 109 along the inner surface of the container 102. The high pressure fluid forces the waste through the grating surface 109, whereby the grating surface 109 cuts the larger sections of the waste into smaller pieces. In other words, the grating surface 109 assists in disintegrating the waste material. Alternatively, the grating surface 109 includes any other appropriate porous surface which aids in cutting the waste material. Nonetheless, the outer wall 108 as well as the grating surface 109 has an appropriate strength to withstand the force of the highly pressurized fluid.

As shown by the arrows in FIG. 1, the fluid delivery mechanism 104, preferably the manifold 111, rotates about a longitudinal vertical axis 99. In one embodiment, the entire manifold 111 rotates as one piece, whereby each nozzle 110 are stationary in relation to the manifold 111. Alternatively, each nozzle 110 rotates independently of one another in relation to the manifold 111. In an alternate embodiment, the fluid delivery mechanism 104 is coupled to a motor (not shown) which causes the manifold 111 to rotate. It is preferred that the nozzles 110 are angled with respect to the axis 99 whereby the fluid delivery mechanism 104 freely rotates about the longitudinal axis 99 due to centrifugal forces caused from fluid flowing through the nozzles 110 at an angle. Alternatively, the mechanism 104 is manually rotatable. Alternatively, the entire container 102 rotates about the axis 99 as the fluid delivery mechanism 104 remains stationary or rotates independently of the container 102. The rotation of the mechanism 104 causes the nozzles 110 to uniformly apply the high pressure stream to the waste present around the fluid delivery mechanism 104. The spiral arrangement of the nozzles 110 along with the rotation of the mechanism 104 allows the apparatus 100 to disintegrate, liquify or break down substantially all of the waste matter held in the container 102 into effluent matter. The effluent matter along with the fluid then flows downward along the bottom surface 107 to the output port 114 and exits the apparatus 100. Preferably, the output port 114 is coupled to a waste storage vessel (not shown) which stores the liquified matter. The effluent matter can then be reusable as compost, mulch, ground covering or any other appropriate matter and has substantial advantages over by-products generated by conventional controlling methods.

FIG. 2 illustrates a side view schematic of an alternative waste disintegrating apparatus in accordance with the present invention. Generally, as shown in FIG. 2, the apparatus 200 preferably includes a container 202, a fluid delivery mechanism 204, a pump 220, a fluid input port 212 and an output port 214. In particular, as shown in FIG. 2, the container 202 includes a bottom component 206 having a bottom surface 207 and an outer wall 208 which is coupled to the bottom component 206. However, the outer wall 208 has any other appropriate shape. In addition, the alternative apparatus 200 also includes a grated surface 209 made of a screen or wire mesh material which aids in disintegrating the waste material when subjected to the high pressure forces from the nozzles 210. In the alternate embodiment shown in FIG. 2, the trash and waste is inserted into the container 102 through the side of the container 102 (not shown). The fluid input port 212 is coupled to the fluid delivery mechanism 204 and is also coupled to the fluid supply unit 218. As shown in FIG. 2, the fluid delivery mechanism 204 is coupled to the fluid input port 212, whereby fluid from the fluid supply unit 218 flows directly to the fluid delivery mechanism 204 via the fluid input port 212.

Figure 3:
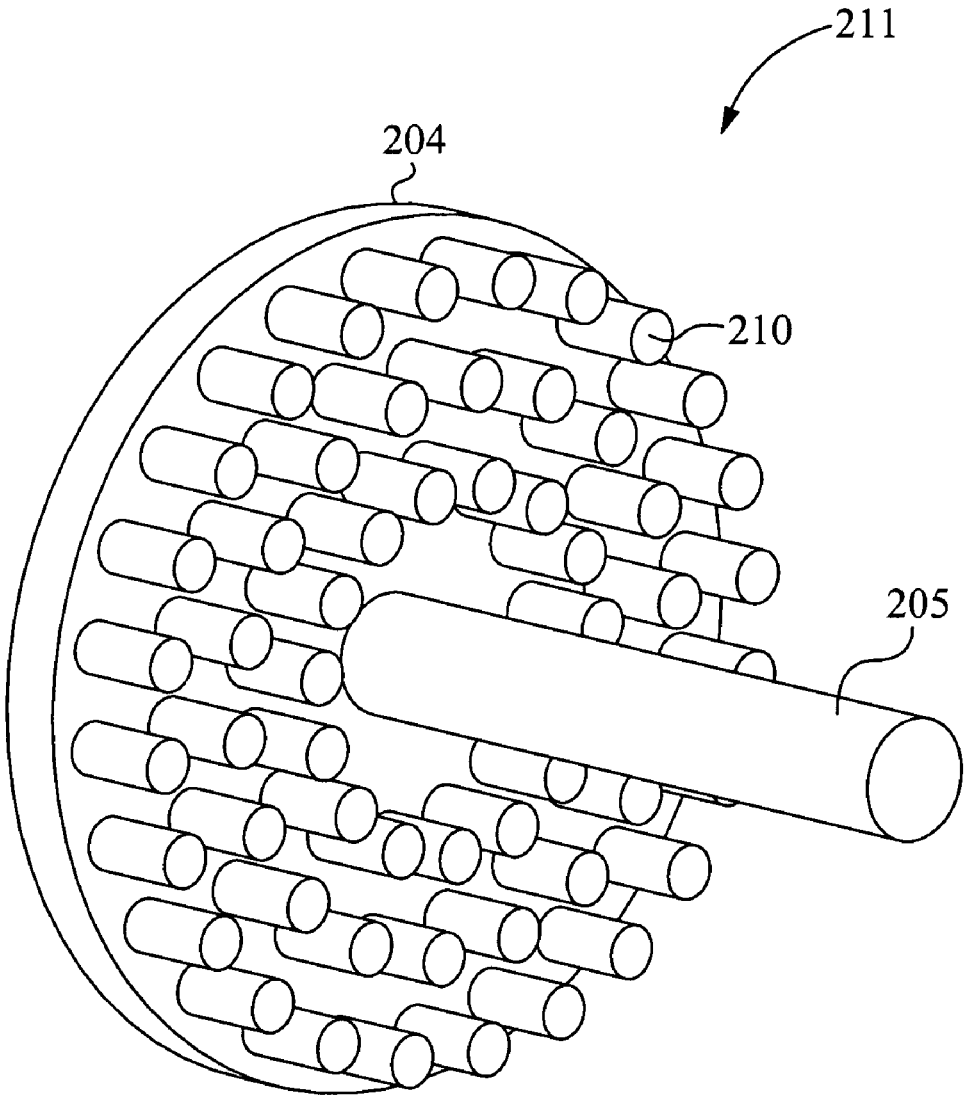
FIG. 3 illustrates a side view schematic of an alternative waste disintegrating apparatus in accordance with the present invention.

The fluid delivery mechanism 204 in FIG. 2 is positioned above the bottom surface 207 and has a cylindrical member 205 coupled thereto. The cylindrical member 205 is also coupled to the bottom component 206 and holds the fluid delivery mechanism 204 above the bottom surface 207. The cylindrical member 205 is aligned along the axis 99 as shown in FIG. 2. As shown in FIGS. 2 and 3, the fluid delivery mechanism 204 includes a disk manifold 211 having several nozzles 210 which extend out therefrom. The nozzles 210 extend out from the bottom surface of the manifold 211 and are pointed down toward the bottom component 206. As shown in FIG. 3, the disk manifold 211 includes several nozzles 210 all along the bottom surface of the manifold 211. However, it is apparent to one skilled in the art that any number of nozzles 210 are alternatively configured in any arrangement and are not limited to the arrangement shown in FIG. 3. Alternatively, the fluid delivery mechanism 204 also includes nozzles 210 arranged vertically along the cylindrical member 205, as shown in FIG. 1 and aligned with respect to the axis 99. It is also apparent to one skilled in the art that the apparatus is alternatively configured opposite to the one shown in FIG. 2, whereby the disk manifold is in the bottom surface and the nozzles point upward.

In operation, high pressure fluid flows from the fluid input port 212 through the disk manifold 211. The disk manifold 211 includes several fluid lines within which appropriately channel the high pressure fluid from the fluid input port 212 to the nozzles 210. Fluid is forced out through the nozzles 210 as streams of highly pressurized fluid. As stated above, the nozzles 210 include zero degree multiplier nozzle tips (not shown) which additionally spreads fluid as it exits through the nozzles 210 as well as keeps substantially all of the fluid in a concentrated stream which effectively disintegrates the waste matter. The stream of highly pressurized fluid is directed at the waste matter within the container 202, whereby the fluid strikes the waste at such a high force that the fluid effectively disintegrates or liquefies the waste into effluent matter. In other words, the force of the stream of fluids from the nozzles 210 striking the waste effectively severs or slice the waste at the individual points of contact. Therefore, in the alternative apparatus shown in FIG. 2, a stream of highly pressurized fluid is delivered through each of the nozzles 210 in the disk manifold 211 toward the bottom component 206, whereby the waste is located in between the manifold 211 and the bottom component 206. Thus, the multiple streams of fluid sever and disintegrate the waste as well as push the waste toward the grated surface 209 wherein the grated surface 209 assists in cutting and disintegrating the waste. The details of the grated surface 209 are discussed above and are not addressed in detail herein. Alternatively, a control circuit (not shown) is coupled to a valve (not shown), whereby the valve is instructed to direct the fluid to one or more selected nozzles 210 at a time.

As shown by the arrows in FIG. 2, the column 205 rotates the fluid delivery mechanism 204 about the vertical longitudinal axis 99. The rotation of the mechanism 204 allows the nozzles 210 to uniformly apply the stream of highly pressurized fluid uniformly around the mechanism 204. The mechanism 204 is manually rotatable, freely rotatable by centrifugal forces, or rotatable by a motor as discussed above. The effluent matter, along with the fluid from the nozzles 210 flow downward from the bottom surface to the output port 214 and exits the apparatus 200. The output port 214 may alternatively be coupled to a waste storage vessel (not shown) which stores the liquified matter. As stated above, the effluent matter can then be reusable as compost, mulch, ground covering or any other appropriate matter.

Figure 4:
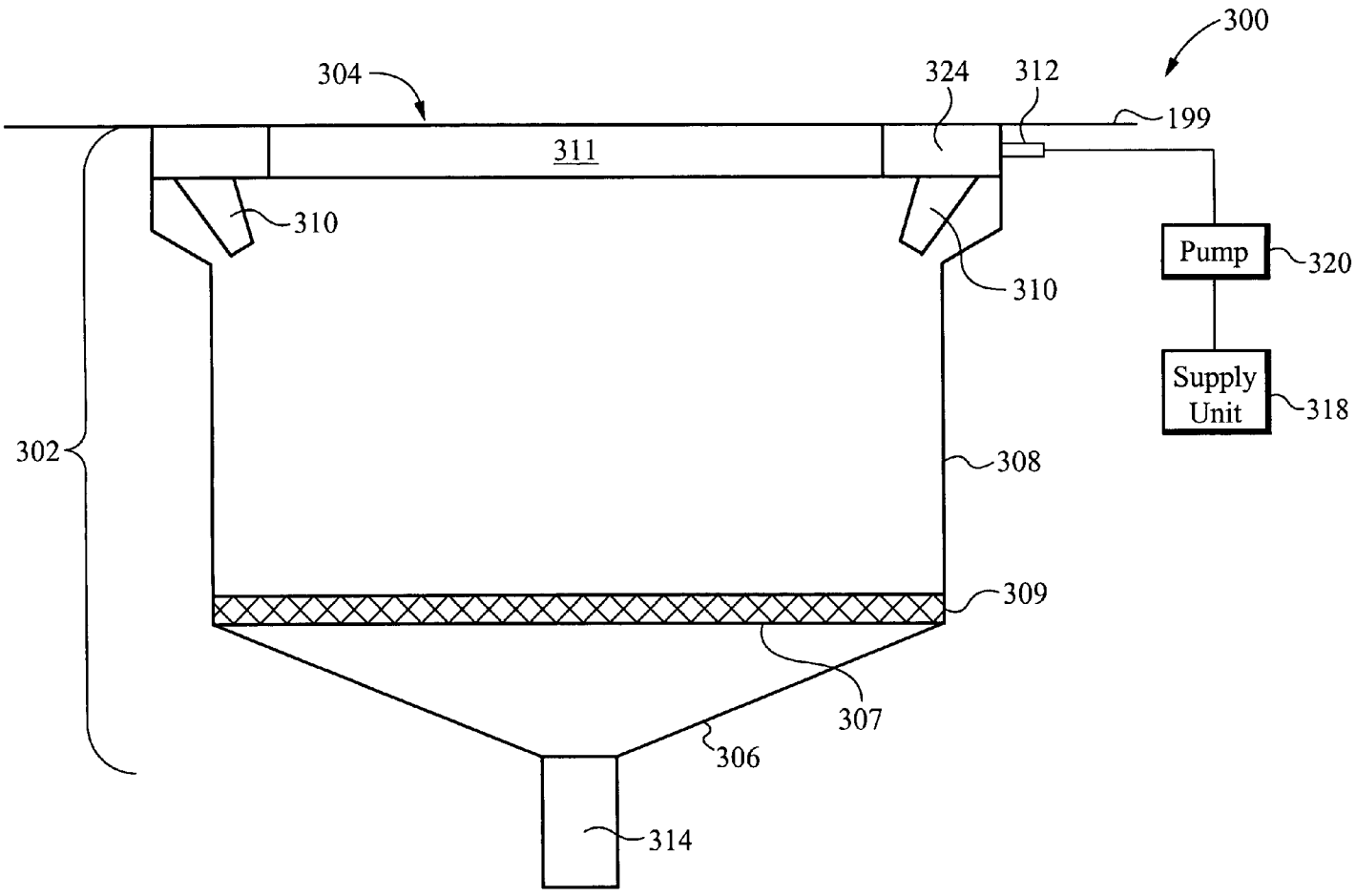
FIG. 4 illustrates a perspective view of a disk manifold in accordance with the present invention.
Figure 5:
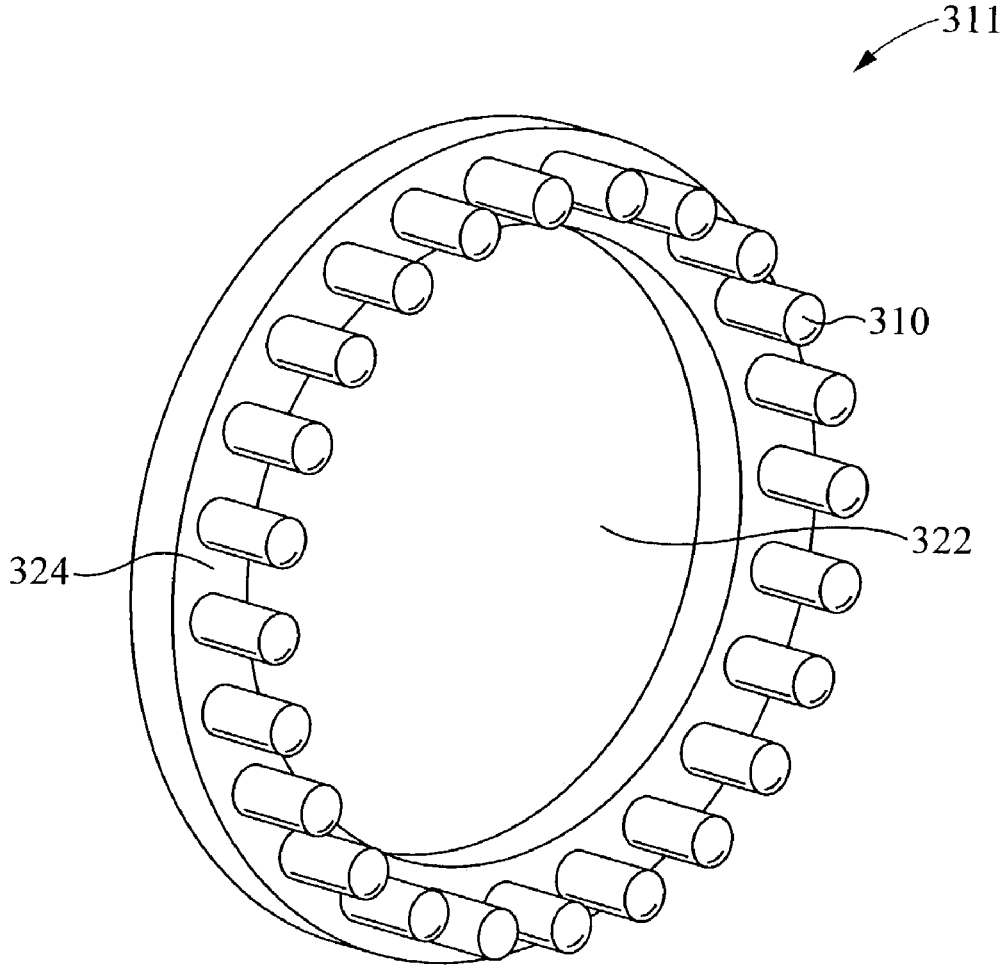
FIG. 5 illustrates a perspective view of a disk manifold in accordance with the present invention.

FIG. 4 illustrates an alternative embodiment of the present invention. In this alternative embodiment, the present apparatus utilizes the high pressure fluid to disintegrate food particles placed down a sink drain. As with the above embodiment, the embodiment shown in FIG. 4 includes a container bin 302, a fluid delivery system 304, a pump 320, a fluid input port 312 and an output port 314. Also as with the above embodiment, the embodiment shown in FIG. 4 includes the container bin 302 having a bottom component 306 and an outer wall 308 coupled to the bottom component 306. Further, FIG. 4 shows a fluid supply unit 318, similar to the fluid supply unit 218 found in FIG. 2. The apparatus in FIG. 4 can be utilized as a garbage disposal which is coupled to a sink drain 199. The alternative apparatus 300 includes a grated surface 309 made of a screen or wire mesh material which aids in disintegrating the waste material when subjected to the high pressure forces from the nozzles 310. The fluid delivery system 304 in FIGS. 4 and 5 has a disk manifold 311 which has an open-center section 322 (FIG. 5) and an outer ring 324, whereby the nozzles 310 extend from the outer ring 324 diagonally and point downward toward the bottom surface 307. A more detailed view of the open-center disk manifold 311 is shown in FIG. 5. The disk manifold 311 is advantageous in the garbage disposal application, because the open-center section 322 allows food stuffs to fall from the sink into the container 302 and the nozzles 310 do not restrict food stuffs from entering the container 302 because they are positioned along the outer perimeter of the apparatus 300. The alternative apparatus 300 in FIG. 4 operates in the same manner as the above embodiments and is not discussed herein.

Figure 6A:
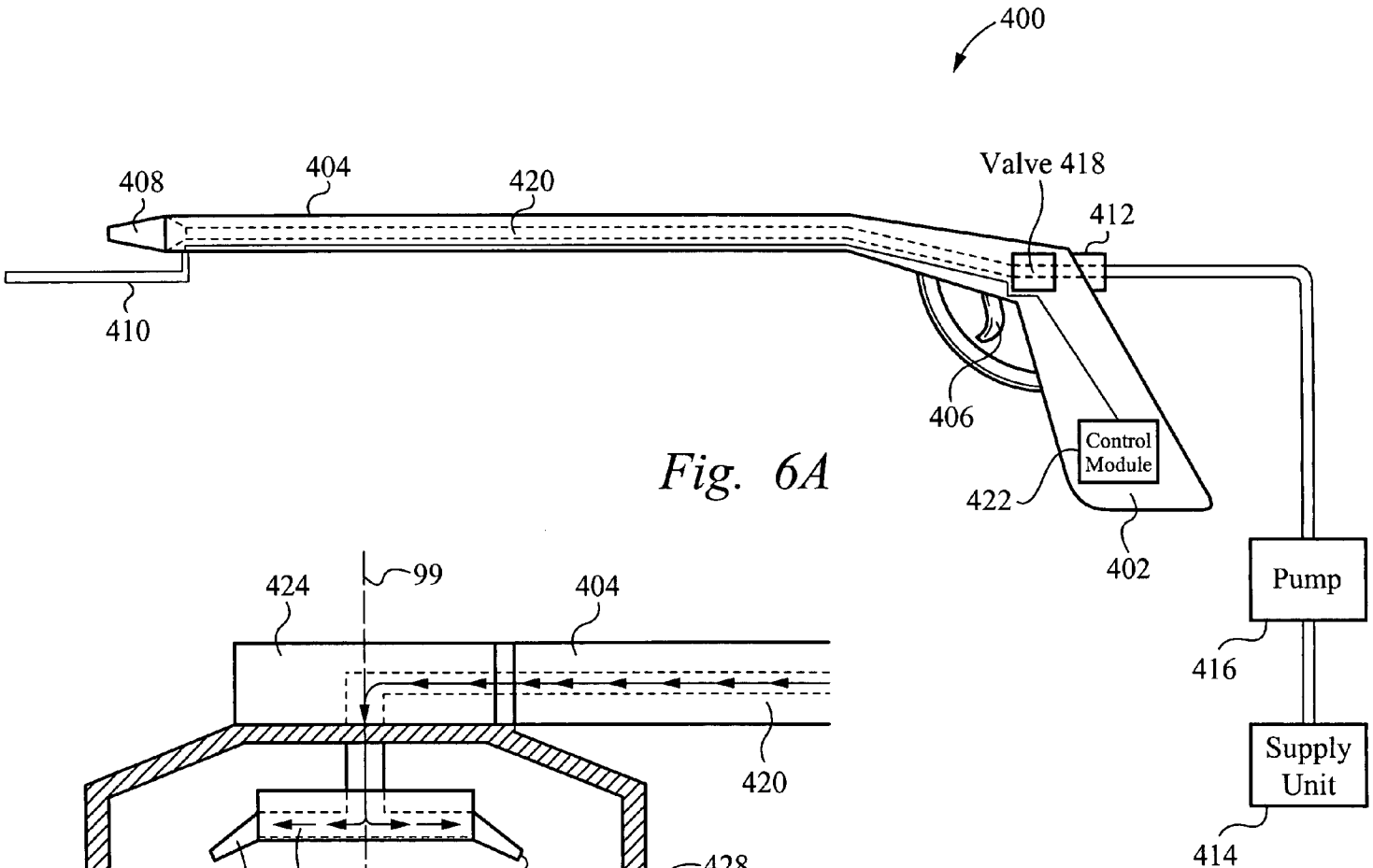
FIG. 6A illustrates a side view schematic of a hand held waste disintegrating apparatus in accordance with the present invention.
Figure 6B:
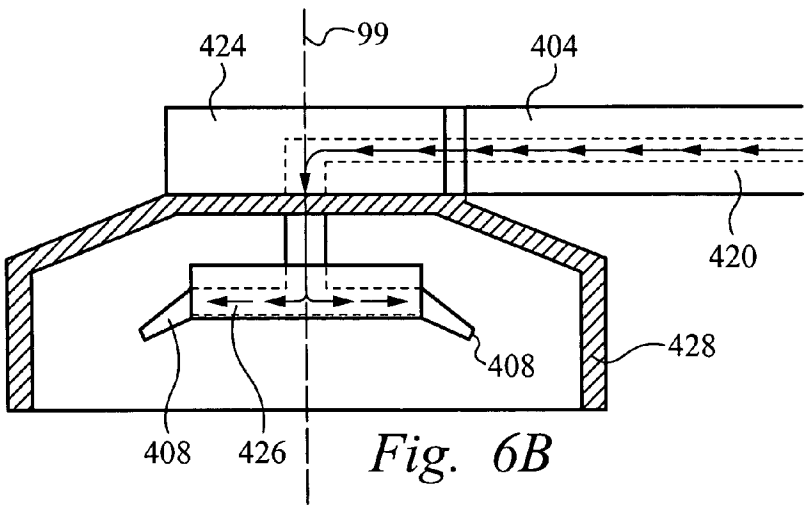
FIG. 6B illustrates a detailed cross sectional view schematic of a disk adapter configured to be used with the hand held waste disintegrating apparatus in accordance with the present invention.

In another embodiment, the fluid delivery system of the present invention is a hand-held device 400 which hydromechanically severs waste. The hand held device 400 is shown in FIG. 6A and has a handle 402, one or more barrels 404, a trigger 406, a detachable nozzle 408 coupled to the barrel 404 and a sensor 410. In one embodiment, the nozzle 408 is coupled to the end of the barrel 404. Alternatively, as shown in FIG. 6B, a rotatable disk 426 is coupled to the end of the barrel 404. In another embodiment, no adapter is coupled to the end of the barrel 404, whereby the wind force from the fluid flowing out of the barrel 404 allows the user to round up or gather matter.

The device 400 has a port 412 which is coupled to a fluid supply unit 414 and pump 416 as well as the fluid supply line 420. As stated above, the fluid is supplied from the fluid supply unit 414, whereby the fluid is compressed under high pressure through the pump 416. In the embodiment shown in FIG. 6A, the hand-held device 400 receives fluid through the port 412, whereby a valve 418 within the device 400 controls the flow of the fluid through the device 400. Actuation of the trigger 406 opens the valve 418, whereby the fluid travels through the open valve 418 via the fluid line 420 to the nozzle 408. As stated above, the nozzle 408 further compresses the fluid through the small diameter aperture, whereby the fluid shoots out of the hand-held device 400 at an extremely high pressure. The high pressure of the fluid, upon striking the waste matter, thereby hydromechanically severs or disintegrates the waste. As stated above, the nozzle 408 includes a zero degree multiplier nozzle tip to assist in delivering the highly pressurized fluid. The nozzle 408 is also preferably configured such that device 400 prevents seeds, pollen, spores and other particulates from being airborne due to the vapor-mist of fluid striking the waste matter. The valve 418 is alternatively a solenoid valve or other valve capable of delivering highly pressurized fluid through the nozzle 408 although other valves are contemplated.

Alternatively, as shown in FIG. 6B, a disk adapter 424 is coupled to the end of the barrel 404. The disk adapter 424 includes a disk 426 which is rotatable about the axis 99. The disk adapter 424 includes one or more nozzles 408 which extend substantially outward at an angle from the side of the disk 426 as shown in FIG. 6B, whereby the nozzle 408 also points slightly downward. The position of the nozzle 408 at an angle with respect to the outer surface of the disk 426 allows centrifugal forces from the fluid passing therethrough to cause the disk 426 to rotate about the axis 99. As shown in FIG. 6B, the disk adapter 424 also includes a guard 428 which confines the fluid stream within the area enclosed by the guard 428 and prevents the fluid stream from striking the user. The disk adapter 424 is alternatively detachable from the barrel 404, whereby the disk adapter 424 can be replaced with the nozzle 408 described above. In addition, the disk adapter 424 may alternatively be used in other machines and devices. For instance, the disk adapter 424 shown in FIG. 6B can alternatively be used in a lawn mower (not shown), whereby the disk adapter 424 would replace the conventional blades that are found in a lawn mower (not shown).

Figure 6C:
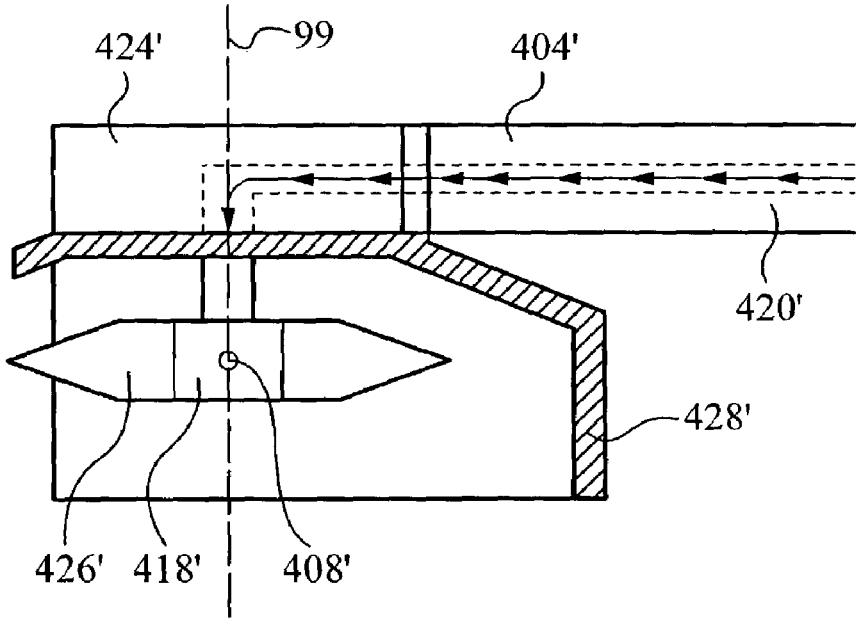
FIG. 6C illustrates a detailed cross sectional view schematic of another disk adapter configured to be used with the hand held waste disintegrating apparatus in accordance with the present invention.

Alternatively, as shown in FIG. 6C, a disk adapter 424' is coupled to the end of the barrel 404'. The disk adapter 424' includes a disk 426' which is rotatable about the axis 99'. The disk adapter 424' includes one or more recesses 418' which are cut away from the edge of the disk 426', whereby one or more nozzles 408' are positioned internally within the disk 426'. Thus, the disk 426' is able strike an object without damaging the nozzle 408'. The position of the nozzle 408' is alternatively at an angle with respect to the outer surface of the disk 426' and allows centrifugal forces from the fluid passing therethrough to cause the disk 426' to rotate about the axis 99'. The disk adapter 424' also includes a guard 428' which confines the fluid stream within the area enclosed by the guard 428' and has an opening in one side to allow the high pressure stream to strike waste matter directly in front of the disk adapter 424'. For illustrative purposes only, the opening of the guard 428' is shown in FIG. 6C as the area to the left of the disk adapter 424'.

Alternatively, as shown in FIG. 6A, a sensor 410 is coupled to the device 400 near the nozzle end for safety purposes. The sensor 410 is coupled to a control module 422, whereby the control module 422 is coupled to the valve 418. In one embodiment, the sensor 410 operates by physically touching the waste matter. However, any other sensor, including but not limited to, sensors using visual, ultrasonic, touch, and heat technology are contemplated in conjunction with the device 400. The sensor 410 senses the waste matter and automatically sends a signal to the control module 422. The signal received causes the control module 422 to instruct the valve 418 to open, thus discharging the highly pressurized fluid. The highly pressurized fluid then flows through the open valve 418 and passes through the fluid line 420 to the nozzle 408. Alternatively, the valve 418 is in the closed position and stays locked until the sensor 410 sends the signal to the control module 422 to unlock the valve 412, whereby the trigger 406 is then able to open the unlocked valve 412 by actuation.

In operation, the user opens fluid flow from the fluid supply unit 414, whereby the fluid travels through the pump 416 and is compressed to be highly pressurized. The pressurized fluid enters the hand held device 400 via the port 412. The valve 418 prevents the fluid from flowing any further until the sensor 410 and/or the trigger 406 opens the valve 418. In one embodiment, the user pulls the trigger 406 to deliver the high pressure fluid. In another embodiment, the sensor 410 directly operates the valve 418 by sending a signal to the control module 422 to open the valve 418. In yet another embodiment, the sensor 410 sends a signal to the control module 422 to unlock the valve 418 whereby the user is then able to pull the trigger 406 to open the valve 418 to deliver the pressurized fluid. The fluid is delivered through the nozzle 408 as a high pressure stream which hydromechanically severs the waste matter upon contact. The waste matter, once disintegrated, can then be placed into the apparatus shown in FIG. 1 or FIG. 2, whereby the apparatus will further disintegrate the waste matter into effluent matter.

It should be noted that the present invention is not limited to the applications shown above. For instance, the present invention can be used which uses conventional cutting means, whereby the fluid delivery mechanism instead of the conventional cutting means is used to cut or disintegrate foliage or any other matter. For example, the fluid delivery mechanism of the present invention can be used in including, but not limited to, lawn mowers, plows, hedge trimmers, mine detecting machinery, ground tilling machinery and any other electric or gas operated devices.

Figure 7:
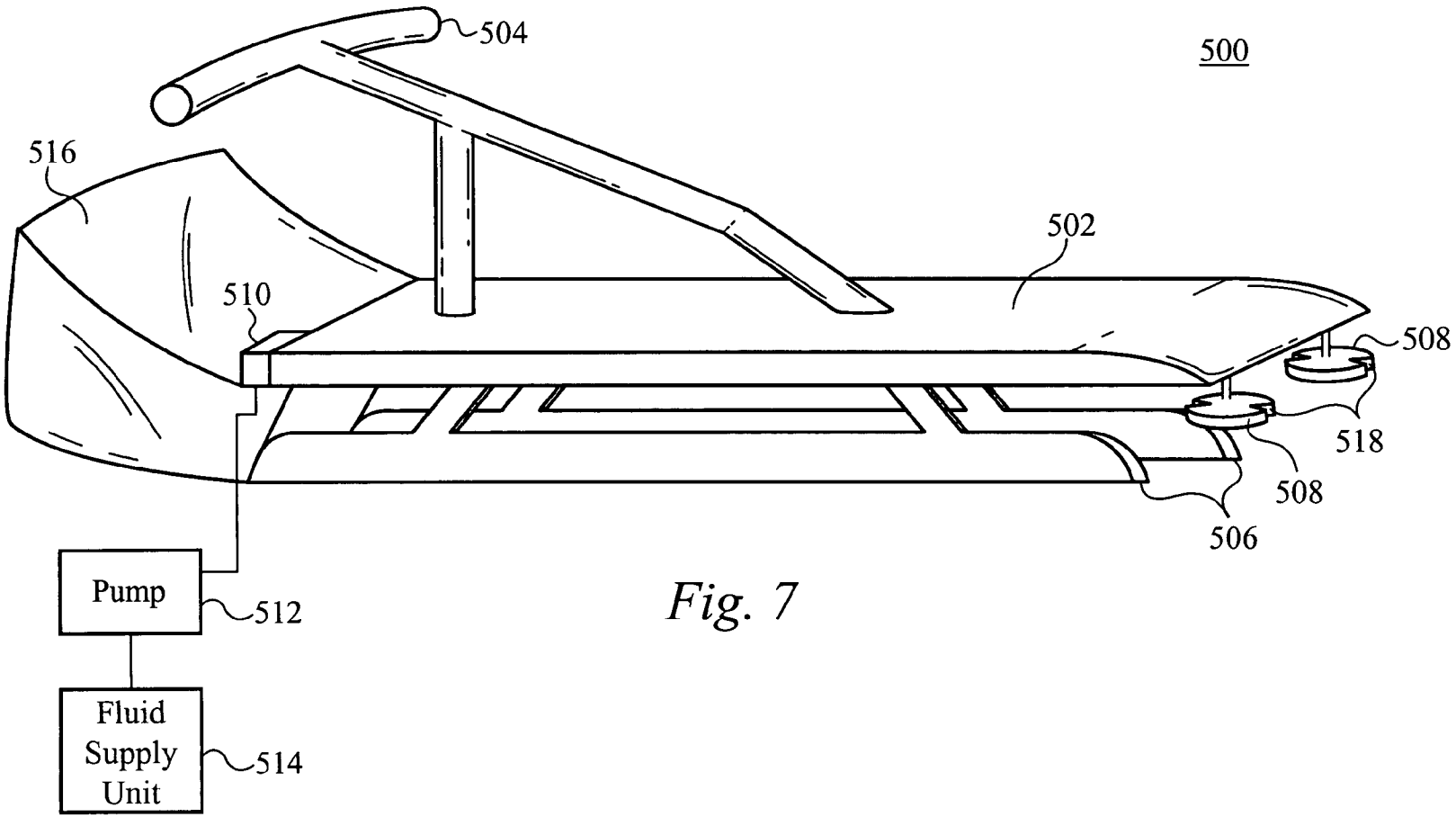
FIG. 7 illustrates a graded land apparatus in accordance with the present invention.

For example, FIG. 7 illustrates a graded land apparatus 500 including a body 502, a handle 504 coupled to the body 502, a pair of thin blades 506 coupled to the body 502, and a pair of disk shaped manifolds 508 of the fluid delivery system coupled to the front of the body 502. In addition, the apparatus 500 includes an inlet port 510 coupled to the body 502 as well as pump 512 coupled to the inlet port 510 and a fluid supply unit 514 coupled to the pump 512. Additionally, the apparatus 500 includes a container 516 coupled to the back side of the body 502 to gather effluent matter generated by the disk shaped manifolds 508. The container alternatively includes the apparatus embodiments shown in FIGS. 1–4. Specifically, disk shaped manifolds 508 are rotatable about a vertical axis, as discussed in relation to FIGS. 6B and 6C. The manifolds 508 are positionable such that the nozzles 518 within the disk shaped manifolds 508 face in toward the center of the body 502 and between the blades 506. Alternatively, manifolds 508 are positionable such that the nozzles 518 within the disk shaped manifolds 508 face away from center of the body 502 or in any other direction. Alternatively, the disk shaped manifolds 508 are independently moveable and operable. Alternatively, the manifolds 508 continuously rotate about the vertical axis under centrifugal forces or by externally powered means.

Fluid entering the apparatus 500 through the inlet port 510 flows through fluid lines (not shown) which channel the fluid to the nozzles 518. The fluid exits one or more of the nozzles 518 at an extremely high pressure, as described above, whereby the high pressure stream of fluid disintegrates waste matter upon contact. In operation, the user moves the apparatus 500 upon the blades 506 by applying force to the handle 504. Alternatively, the apparatus 500 is self propelled or is attached to a moving vehicle. In addition, a pump 512 provides highly pressurized fluid to the inlet port 510, whereby fluid exits the one or more nozzles 518 at a high pressure to effectively disintegrate blight or other waste matter in the path of the apparatus 500. Thus, the apparatus 500 utilizes the highly pressurized fluid delivered through the disk shaped manifolds 508 to clear the area of waste around the apparatus 500.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. An apparatus for disintegrating waste matter comprising:

a. a fluid source for supplying fluid;

b. a pump coupled to the fluid source, wherein the pump pressurizes the fluid into a highly pressurized fluid;

c. a fluid delivery mechanism coupled to the pump, the fluid delivery mechanism for delivering a pulsating stream of the highly pressurized fluid, the stream of highly pressurized fluid capable of disintegrating waste matter upon contact;

d. a holding area for holding the waste matter, the holding area coupled to the fluid delivery mechanism and comprising a container bin having a bottom surface and an outer wall extending upwardly from the bottom surface; and e. a porous surface for retaining the waste matter, until the waste matter becomes a smaller size than an opening in the porous surface.

2. The apparatus according to claim 1 wherein the highly pressurized fluid applies a force sufficient to hydromechanically sever the waste matter.

3. The apparatus according to claim 1 wherein the waste matter is an organic material.

4. The apparatus according to claim 1 wherein the holding area further comprises an outlet port coupled to the bottom surface, wherein the disintegrated waste material exits the container bin via the outlet port.

5. The apparatus according to claim 1 wherein the fluid delivery mechanism is disposed within the container bin.

6. The apparatus according to claim 1 wherein the fluid delivery mechanism further comprises at least one nozzle for compressing the highly pressurized fluid.

7. The apparatus according to claim 6 wherein the at least one nozzle is rotatably configured such that the highly pressurized fluid exits the nozzle in a pulsating manner.

8. The apparatus according to claim 6 wherein the at least one nozzle further comprises a zero degree nozzle tip for compressing the highly pressurized fluid entering the at least one nozzle.

9. The apparatus according to claim 6 wherein the at least one nozzle rotates about the axis to rotatably disintegrate the waste material.

10. The apparatus according to claim 9 further comprising a motor coupled to the fluid delivery mechanism, wherein the motor drives the fluid delivery mechanism to rotate.

11. The apparatus according to claim 9 wherein the fluid delivery mechanism rotates by centrifugal forces from the at least one nozzle applying the pulsating stream of the highly pressurized fluid.

12. The apparatus according to claim 1 wherein the fluid delivery mechanism further comprises a manifold positioned along an axis, wherein at least one nozzle extends outward from the manifold.

13. The apparatus according to claim 12 wherein the manifold further comprises a disk shaped member rotatable about the axis.

14. The apparatus according to claim 12 further comprising a guard component coupled to the manifold, the guard component configured to confine the pulsating stream of the highly pressurized fluid from the nozzle.

15. The apparatus according to claim 1, wherein the porous surface cuts the waste matter.

16. An apparatus for hydromechanically severing waste material comprising:

a. a fluid source for supplying fluid;

b. a pump coupled to the fluid source and configured to provide fluid at a high pressurized condition;

c. at least one nozzle coupled to the fluid source and configured to apply a pulsating stream of highly pressurized fluid to the waste material, wherein the stream of highly pressurized fluid is capable of severing the waste material by force;

d. a receptacle for containing the waste material and coupled to the fluid source, the receptacle comprising a bottom surface and an outer wall extending upwardly from the bottom surface; and e. a porous surface for retaining the waste material, until the waste material becomes a smaller size than an opening in the porous surface.

17. The apparatus according to claim 16 further comprising an outlet port coupled to the bottom surface, wherein the disintegrated waste material exits the receptacle via the outlet port.

18. The apparatus according to claim 16 wherein the at least one nozzle further comprises a zero degree nozzle tip for compressing fluid entering the at least one nozzle.

19. The apparatus according to claim 18 wherein the at least one nozzle is rotatably configured such that the highly pressurized fluid exits the nozzle in a pulsating manner.

20. The apparatus according to claim 18 wherein the at least one nozzle is coupled to a manifold positioned along an axis, wherein the at least one nozzle extends outward from the manifold.

21. The apparatus according to claim 20 wherein the manifold is rotatable about the axis.

22. The apparatus according to claim 20 wherein the manifold is disk shaped.

23. The apparatus according to claim 22 further comprising a motor coupled to the manifold, wherein the motor drives the at least one nozzle to rotate about the axis.

24. The apparatus according to claim 22 wherein the at least one nozzle rotates by centrifugal forces.

25. The apparatus according to claim 20 wherein the manifold is a cylindrical shape.

26. The apparatus according to claim 16 wherein the waste matter is an organic material.

27. The apparatus according to claim 16, wherein the porous surface cuts the waste material.

28. A method of decomposing waste matter comprising the steps of:

a. configuring a fluid delivery mechanism to be capable of directing a pulsating, highly pressurized fluid toward the waste matter;

b. coupling a fluid source to the fluid delivery mechanism;

c. coupling a holding area to the fluid delivery mechanism for holding the waste matter, the holding area comprising a container bin having a bottom surface and an outer wall extending upwardly from the bottom surface;

d. configuring a porous surface for retaining the waste matter, until the waste matter becomes a smaller size than an opening in the porous surface; and e. applying the pulsating highly pressurized fluid from the fluid source to the fluid delivery mechanism, wherein the applied highly pressurized fluid hydromechanically disintegrates the waste matter.

29. The method according to claim 28 wherein the waste matter is an organic material.

30. The method according to claim 28 further comprising the step of coupling an outlet port to the bottom surface, wherein the disintegrated waste material exits the container bin via the outlet port.

31. The method according to claim 28 wherein the fluid delivery mechanism is disposed within the container bin.

32. The method according to claim 31 wherein the fluid delivery mechanism further comprises at least one nozzle, the at least one nozzle for compressing fluid entering the at least one nozzle into the highly pressurized fluid.

33. The method according to claim 32 wherein the at least one nozzle is rotatably configured such that the highly pressurized fluid exits the nozzle in a pulsating manner.

34. The method according to claim 32 wherein the at least one nozzle further comprises a zero degree nozzle tip.

35. The method according to claim 32 further comprising the step of configuring the fluid delivery mechanism to include a column positioned along a longitudinal axis, wherein the at least one nozzle extends outward from the column and is directed substantially toward the outer wall.

36. The method according to claim 32 further comprising the step of configuring the fluid delivery mechanism to rotate about an axis to rotatably disintegrate the waste material within the container bin.

37. The method according to claim 36 further comprising the step of coupling a motor to the at least one nozzle, wherein the motor drives the at least one nozzle to rotate.

38. The method according to claim 36 wherein the at least one nozzle rotates by centrifugal forces from the at least one nozzle applying the pulsating stream of the highly pressurized fluid.

39. The method according to claim 28, wherein the porous surface cuts the waste matter.

40. An apparatus for decomposing waste matter comprising:

a. means for supplying fluid to the apparatus;

b. means for pressurizing the fluid into a highly pressurized fluid;

c. means for holding the waste matter; and d. means for applying the highly pressurized fluid in a pulsating stream to the waste matter, wherein the highly pressurized fluid disintegrates the waste matter into effluent matter.

41. The apparatus according to claim 40 further comprising means for cutting the waste matter.

42. The apparatus according to claim 41, wherein the means for cutting the waste matter further comprises a porous surface.

* * * * *